US005685105A

United States Patent [19]

Teetzel

[11] Patent Number: 5,685,105

[45] Date of Patent: Nov. 11, 1997

[54] APPARATUS FOR ATTACHING A FLASHLIGHT TO A FIREARM

[76] Inventor: James W. Teetzel, 151 Lafayette Rd., Portsmouth, N.H. 03801

[21] Appl. No.: 488,631

[22] Filed: Jun. 8, 1995

Related U.S. Application Data

[63] Continuation-in-part of Ser. No. 303,860, Sep. 9, 1994, Pat. No. 5,584,137, which is a continuation-in-part of Ser. No. 200,204, Feb. 23, 1994, Pat. No. 5,481,819, which is a continuation-in-part of Ser. No. 89,889, Jul. 12, 1993, Pat. No. 5,425,299, which is a continuation-in-part of Ser. No. 73,766, Jun. 8, 1993, Pat. No. 5,355,608.

[51] Int. Cl.[6] ..... F41G 1/35

[52] U.S. Cl. ..... 42/103; 362/114

[58] Field of Search ..... 42/103; 362/110, 362/113, 114

[56] References Cited

U.S. PATENT DOCUMENTS

| | | | |
|---|---|---|---|
| 4,584,632 | 4/1986 | Brinkmann | 362/133 |
| 4,890,407 | 1/1990 | Nichols | 42/103 |
| 4,934,085 | 6/1990 | Lough | 42/103 |
| 5,177,309 | 1/1993 | Willoughby et al. | 362/110 |
| 5,430,967 | 7/1995 | Woodman, III et al. | 42/103 |
| 5,465,197 | 11/1995 | Chien | 362/203 |

FOREIGN PATENT DOCUMENTS

| | | | |
|---|---|---|---|
| 401410 | 11/1945 | Italy | 42/103 |

OTHER PUBLICATIONS

Shooting Times, Lights . . . Taurus . . . Action!, Mar. 1990, 1 page.

*Primary Examiner*—Stephen M. Johnson
*Attorney, Agent, or Firm*—William B. Ritchie

[57] ABSTRACT

A flashlight module that can fit conventional handguns and rifles without requiring major modification of the weapons and yet fits within the profile of the weapons framework. The invention features a chassis containing a flashlight that can be mounted in various positions, depending on the weapon selected. For a handgun, the chassis mounts on the front face of the muzzle. The weapons factory installed hand grips are replaced by modified hand grips that contain the flashlight electronic controls, water proof activation switches, and power source. The hand grips are wired to the chassis via a flexible internal circuit tape in the case of the 9 mm and waterproof quick disconnect cable for the M-16. The apparatus is designed to be used with commercially available batteries providing several hours of operating time.

4 Claims, 3 Drawing Sheets

APPARATUS FOR ATTACHING A FLASHLIGHT TO A FIREARM

This application is a continuation-in-part of U.S. patent application Ser. No. 08/303,860, filed Sep. 9, 1994, now issued as U.S. Pat. No. 5,584,137, which is a continuation-in-part of U.S. patent application Ser. No. 08/200,204, filed Feb. 23, 1994, now issued as U.S. Pat. No. 5,481,819, which is a continuation-in-part of U.S. patent application Ser. No. 08/089,889, filed Jul. 12, 1993, now issued as U.S. Pat. No. 5,425,299, which is a continuation-in-part of U.S. patent application Ser. No. 08/073,766, filed Jun. 8, 1993, now issued as U.S. Pat. No. 5,355,608.

BACKGROUND OF THE INVENTION

1. Field of the Invention

The invention relates to an apparatus for attaching a flashlight on small firearms, particularly semi-automatic handguns and rifles.

2. Description of the Related Art

It is well known that even a skilled marksman with a handgun has been unable to hit a target as close as 7 meters when attempting to draw the weapon and fire at speed. In target shooting, the shooter must obtain the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, the trigger, the sights being in focus must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances are substantially lower, accuracy is still vital. Law enforcement officials are instructed to fire only as a last resort, cognizant of the fact that their intended target will most likely be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet, where millimeters can mean the difference between death and survival, cannot be known a priori by the even the most skilled marksman.

Mechanical sights have limited value in many situations where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstances, the officer must reach around his/her shield or other barricade and instinctively aim and fire his/her gun with the handgun in a very different orientation than would be experienced if fired from a standing, "drawn from a holster" position. Small changes in barrel orientation due to the sight radius of the typical law enforcement handgun can produce substantial errors relative to the target. Accurate, instinctive shooting is not considered practical beyond 20 feet for the average shooter.

The same problems face a soldier in a combat situation. While a rifle is inherently more accurate that a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particular in combat simulated situations.

An additional problem encountered in the military situation is the need for a sighting system that can be easily moved from one weapon to another. As warfare increases in sophistication, the need for more versatile armament increases correspondingly. Ideally, an operator should be able to quickly and confidently move the sighting system from one weapon to another without needing any field adjustments.

A solution to this problem for handguns has been the introduction of laser sights. The typical laser sight is mounted on the top or on the bottom of the handgun. The laser sight when properly aligned, places a red light dot on the target where the bullet will strike if the gun is fired. Using this type of sight enables the law enforcement officer to rapidly and instinctively position the weapon properly and be certain of his/her intended target. Using a laser sight enables accurate shots to be fired at distances of more than 50 feet, sufficient for most combat law enforcement situations requiring the use of handguns.

Another problem that an officer must face is when he/she must fire a gun at a target without sufficient light to properly obtain a sight picture. Under these circumstances, instinctive aiming is used to point the gun barrel at the intended target. However, a typical solution has been to hold a flashlight in one hand to illuminate the darkened area while the gun is held in the other hand. The tradeoff in this methodology is a reduction in target accuracy when the gun is fired. Without using both hands to steady the gun, the same level of target accuracy cannot be achieved.

Prior art flashlight devices for attachment to a gun have several disadvantages. As they are mounted either on the top or bottom of the weapon, the balance of the gun is disturbed which makes it more difficult for the shooter to accurately fire the weapon. As prior art flashlight devices are bulky when used with a handgun, the weapon cannot be used in a standard holster unless the flashlight is removed each time. Further, the flashlight is vulnerable to being hit due to the typical profile of such a device when attached to a handgun.

A flashlight capable of being installed to a semi-automatic handgun or on a military rifle, with a compact profile, and easily moveable from one weapon to another requiring a minimum replacement of standard parts is not disclosed in the prior art.

SUMMARY OF THE INVENTION

It is an object of the invention to provide an apparatus for attaching a flashlight to a firearm that can substantially fit within the profile of the weapon.

It is another object of the invention to provide an apparatus for attaching a flashlight to a firearm that can be retro-fitted to standard semi-automatic handguns or to standard military rifles.

It is still another object of the invention to provide an apparatus for attaching a flashlight to a firearm that can be easily moved from one weapon to another.

It is still another object of the invention to provide an apparatus for attaching a flashlight to a firearm that can be fitted to various semi-automatic handguns and military rifles requiring a minimum replacement of standard parts.

It is another object of the invention to provide an apparatus for attaching a flashlight to a firearm that can be inexpensively produced using primarily commercially available parts.

It is another object of the invention to provide an apparatus for attaching a flashlight to a firearm that is extremely light compared to existing flashlights and their mounts.

It is still another object of the invention to provide an apparatus for attaching a flashlight to a firearm that can be controlled using an easily operated keypad.

It is a final object of the invention to provide an apparatus for attaching a flashlight to a firearm that can be powered by commercially available batteries, providing at least several hours of service time before needing to be changed. The invention is a flashlight module for a firearm. A mount adaptor mountable on said firearm is provided. A flashlight module, releasably attachable to said mount adaptor is provided. Said flashlight module has a front with a light source housed within said flashlight module. The light from said light source exits the front face of said flashlight module. Control means for controlling the operation of said flashlight module is provided. Connection means for communication between said flashlight module is provided such that a signal from an operator indicating said light source of said flashlight module is to be activated is communicated to said flashlight module. Said flashlight module can be easily moved to a different weapon so equipped without the need for additional modifications.

DETAILED DESCRIPTION OF THE INVENTION

Figure 1:
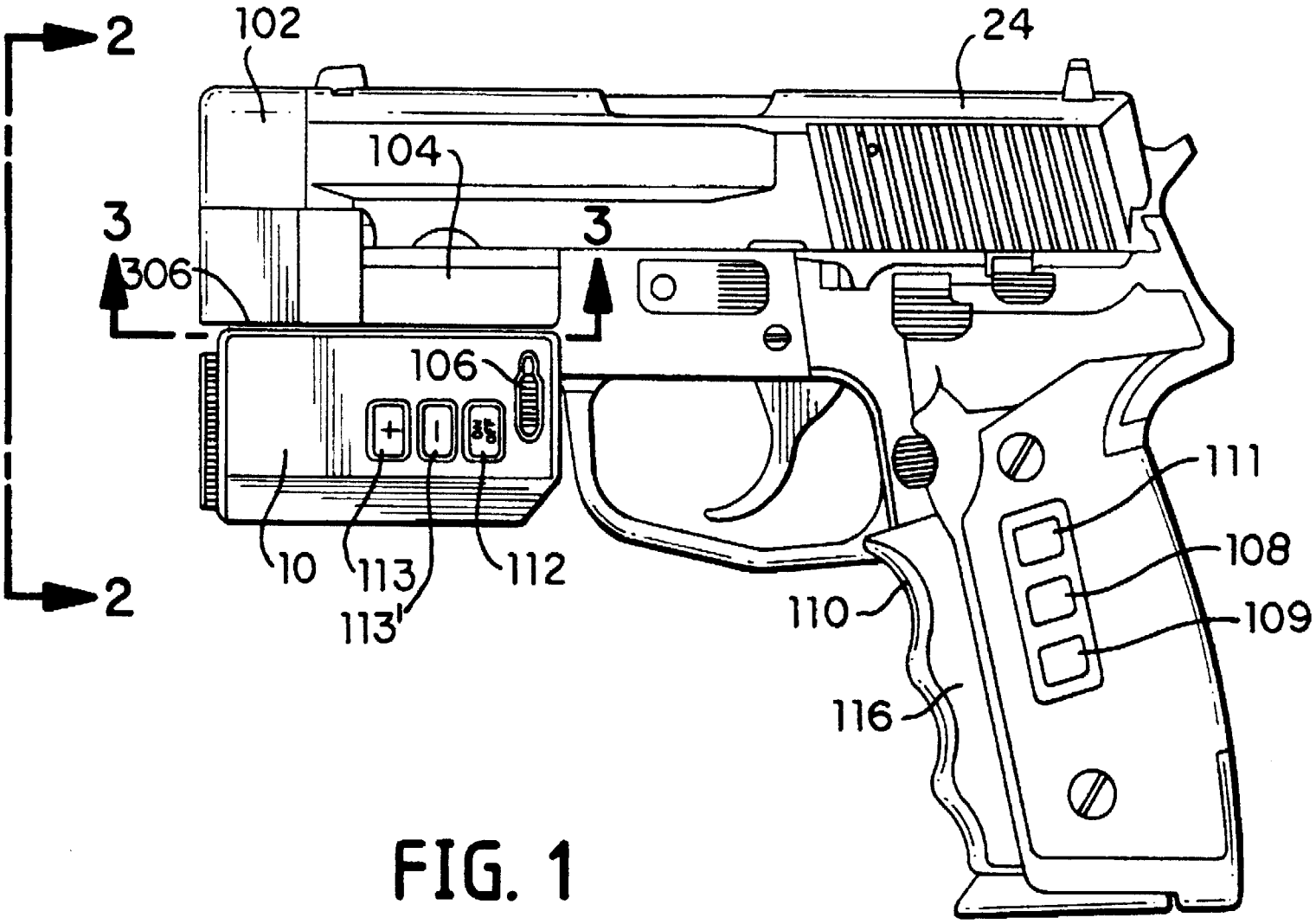
FIG. 1 is a side view of the attachable flashlight mounted on a typical handgun.

The invention is an apparatus for attaching a flashlight to a firearm, such as an offensive handgun or a military rifle. As shown in FIG. 1, flashlight module 10 attaches to weapon 24 via mount-adaptor 104 which allows the operator to quickly move flashlight module 10 from one weapon platform to another or to be used as an independent hand-held unit.

Flashlight module 10 utilizes manual keypad control 112 for on/off operation. Button 113 and 113' are used to control the intensity of the flashlight module 10. Illumination is effective up to 25 meters. At the maximum distance, the diameter of the beam is approximately 2.5 meters.

Quick release lever 106 secures flashlight module 10 to mount adapter 104. Once secured, the operator may turn flashlight module 10 on/off through manual keypad control 112 or, if the weapon is equipped with the inventor's laser sight system, operation can be accomplished through the handgrips of the weapon as shown. Since IR detector 306 is used to control flashlight module 10, flashlight module 10 can be controlled at remote distance by a device such as the inventor's laser sight that is capable of emitting the appropriate infrared. An operator merely depresses activation keypad 110 located beneath rubberized grip boot 116 to turn the unit on. Rubberized button 108 allows flashlight module 10 to be activated by depression of rubberized grip boot 116. Button 109 and 111 control the laser sight. An activation signal is sent through laser sight to flashlight module via infrared communications port 306.

Figure 2:
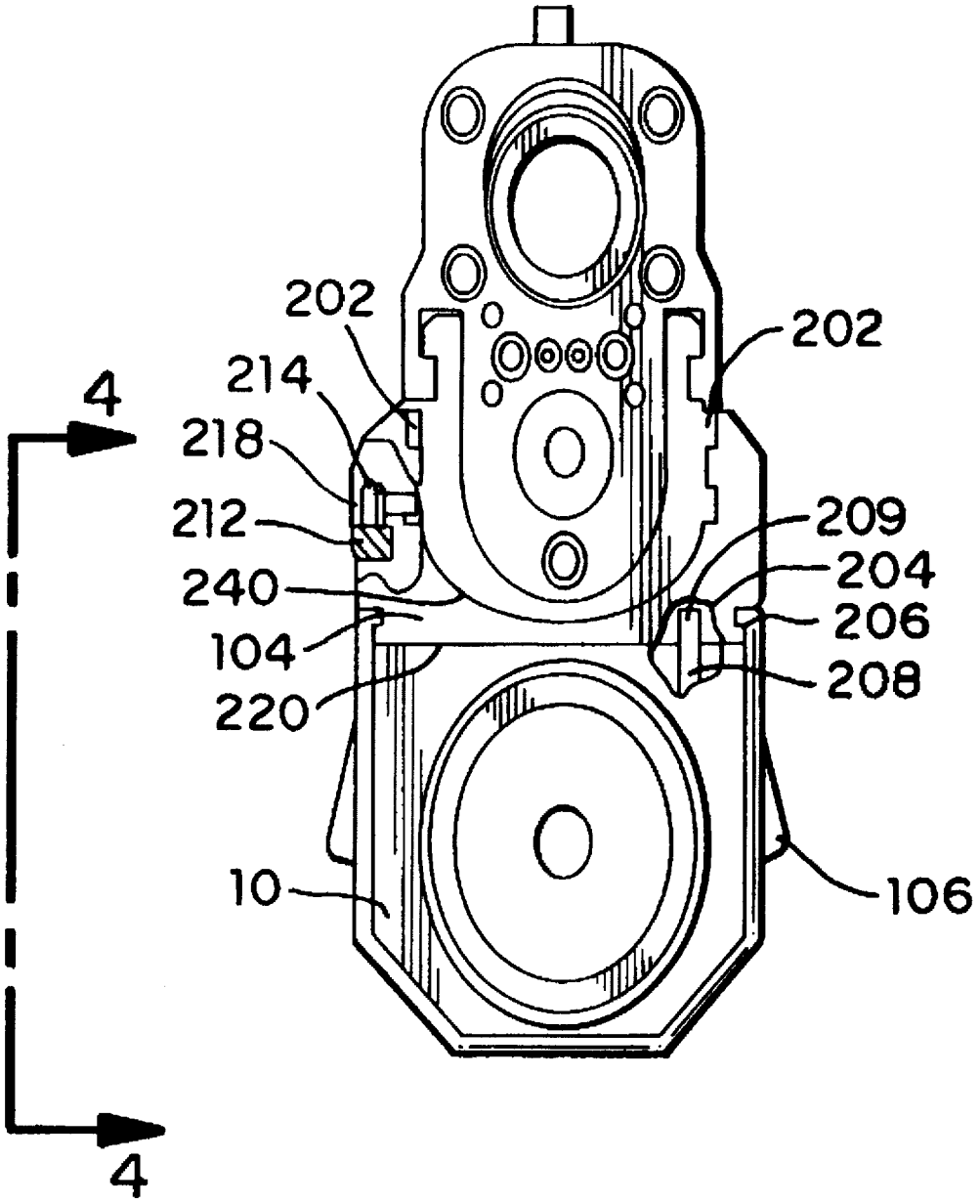
FIG. 2 is a partial exploded view along section line AA of FIG. 1.
Figure 3:
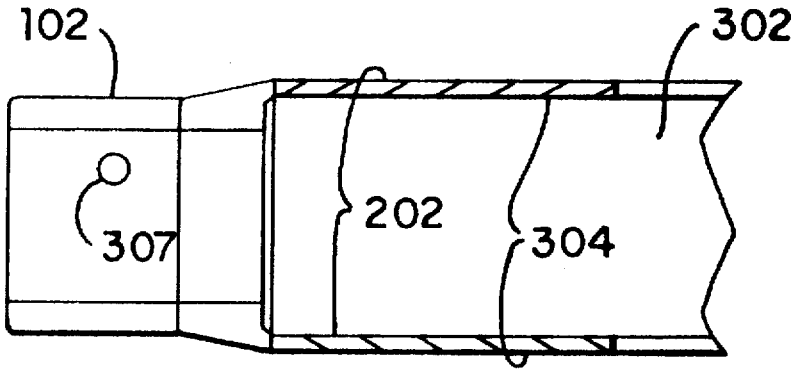
FIG. 3 is a partial exploded view along section line BB of FIG. 1.

Referring now to FIGS. 2 and 3, the details of how flashlight module 10 is attached to firearm 24 will be discussed.. Two plastic or aluminum rails 202 are affixed via double side adhesive 304 to the firearm chassis 302. Mount adaptor 104 is secured to capture rails 202 by sliding mount adaptor 104 along the two capture rails 202 until locked in position utilizing sliding activator 212 that causes locking pin plunger 214 to locate and lock into a corresponding locking pin hole 218 in mount adaptor 104. Locking pin plunger 214 is located on only one side of capture rails 202 and is molded as part of capture rail 202 itself. Counterbore 218 is machined into mount adaptor 104 and corresponds to a diameter and depth such that locking pin plunger 214 will fit. Capture rails 202 are manufactured from either plastic or aluminum.

Surface contour 240 of mount adaptor 104 is dimensioned to fit the profile of weapon 24. When mount adaptor 104 is mounted on a different weapon, surface contour 240 or other aspects of the geometry of the weapon may change. However, the attachment apparatus features described herein will be substantially the same for every version. In this manner, flashlight module 10 can be moved from weapon to weapon without requiring any modifications.

Flashlight module 10 is attached to mount adaptor 104 via female dovetail 204 and male dovetail 206. Female dovetail 204 is on flashlight module 10, as shown in FIG. 2, with the corresponding male dovetail on mount adaptor 104. Positioning of male dovetail 206 and female dovetail 204 can be reversed and their purpose of securing flashlight module 10 to mount adaptor 104 would not be impacted.

Release lever 106 is firmly pressed which forces locking pin plunger 208 to recess flush with module top 220. This allows flashlight module 10 to engage dovetails 204 and 206. After engagement has passed locking pin plunger 208, release lever 106 can be released while flashlight module 10 is slid into place. When the operator hears locking pin plunger 208 clicking into counterbore 209, flashlight module 10 is firmly secured to mount adaptor 104. Counterbore 209 is machined into mount adaptor 104 and corresponds to a diameter and depth such that locking pin plunger 208 will fit.

For interchangability of flashlight module 10, the operator presses release lever 106 and slides flashlight module 10 along dovetails 204 and 206.

FIG. 3 is a partial exploded view along section line BB of FIG. 1. Double sided adhesive tape 304 is applied to weapon frame 302 which provides the support required to hold mounting adaptor 104 in place. When weapon 24 utilizes laser sight chassis 102, flashlight operation can be accomplished via activation keypad 110. An infrared signal is routed through weapon 24 to infrared emitter port 307. The preferred parts list and electrical connections have been previously described in great detail in the U.S. patent application Ser. No. 08/303,860, incorporated herein.

Figure 4:
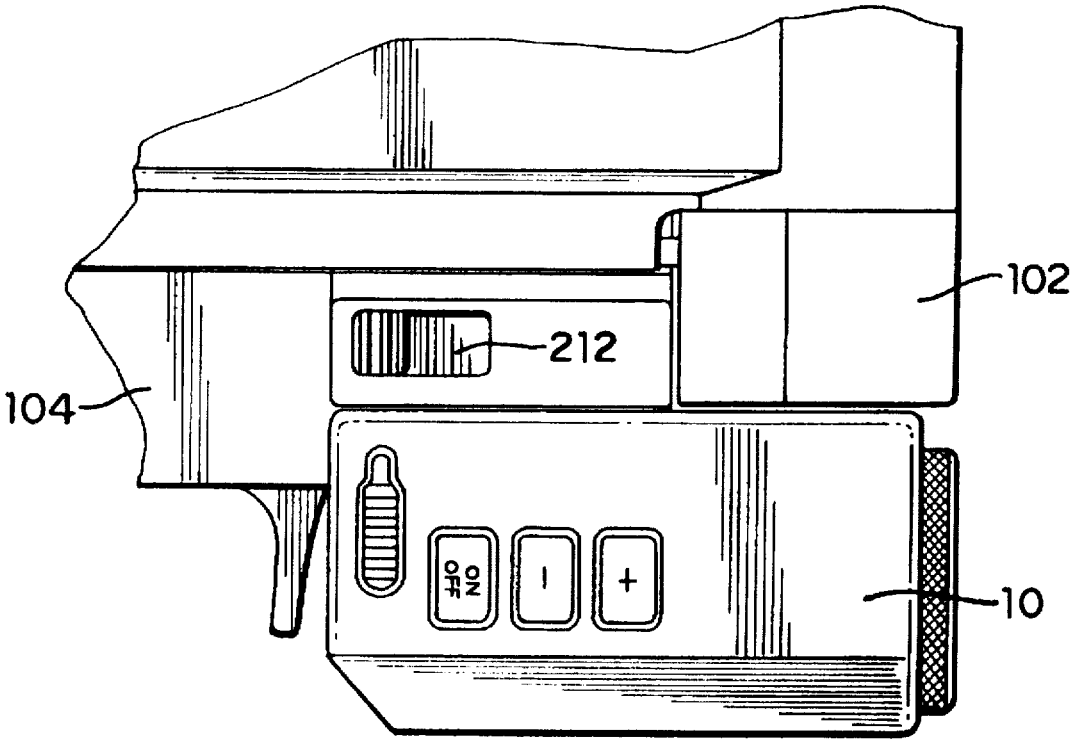
FIG. 4 is a partial exploded view along section line DD of FIG. 2.

FIG. 4 is a partial exploded view along section line DD of FIG. 2. Flashlight module 10 is attached to mount adaptor 104 which is secured to weapon 24. A side view of weapon 24 clearly shows sliding activator 212. Sliding activator 212 locks mount adaptor 104 to capture rails 202, which are shown in FIG. 3.

The invention is powered by commercially available batteries; 2 size "AAA" batteries (not shown) are housed inside flashlight module 10. Approximately several hours of continuous flashlight use is provided by the batteries.

While there have been described what are at present considered to be the preferred embodiments of this invention, it will be obvious to those skilled in the art that various charges and modifications may be made therein without departing from the invention and it is, therefore, aimed to cover all such changes and modifications as fall within the true spirit and scope of the invention.

What is claimed is:

1. A flashlight apparatus for a firearm comprising:

a mount adaptor mountable on said firearm, said mount adapter being attached to said firearm via two rails that are attached to said firearm using two-sided adhesive;

a flashlight module, releasably attachable to said mount adapter, said flashlight module having a front face with a light source housed within said flashlight module, with the light from said light source exiting the front face of said flashlight module;

first control means for controlling the operation of said flashlight module, said control means is attached to said flashlight module, wherein said flashlight module can be released from said mount adaptor via a quick release lever.

2. The flashlight apparatus of claim 1 for a firearm with handgrips, said apparatus further comprising:

second control means for controlling the operation of said flashlight module, wherein said second control means is attached to the handgrips of said firearm.

3. The apparatus of claim 2 wherein second control means controls the operation of said flashlight module through an infrared signal via infrared emitter port.

4. The flashlight apparatus of claim 1 wherein said first control means is a manual keypad.

* * * * *